United States Patent [19]

Booth

[11] 3,977,180

[45] Aug. 31, 1976

[54] AUTOMATIC CHAIN MANUFACTURING SYSTEM

[75] Inventor: Richard L. Booth, Munster, Ind.

[73] Assignee: S. G. Taylor Chain Company, Inc., Hammond, Ind.

[22] Filed: Aug. 7, 1975

[21] Appl. No.: 602,838

[52] U.S. Cl. ..... 59/16; 59/27; 59/31; 219/51

[51] Int. Cl.[2] ..... B21L 3/00

[58] Field of Search ..... 59/16, 18, 22, 23, 24, 59/25, 27, 31–35; 219/51, 52

[56] References Cited

UNITED STATES PATENTS

| | | | |
|---|---|---|---|
| 2,806,345 | 9/1957 | Phares | 59/29 |
| 3,355,876 | 12/1967 | Oettinger | 59/35 |
| 3,701,251 | 10/1972 | Andreasson | 59/16 |
| 3,909,575 | 9/1975 | Phares | 219/51 |
| 3,909,576 | 9/1975 | Phares | 219/51 |

FOREIGN PATENTS OR APPLICATIONS

| | | | |
|---|---|---|---|
| 1,094,241 | 12/1967 | United Kingdom | 59/31 |

*Primary Examiner*—Lowell A. Larson
*Assistant Examiner*—Gene P. Crosby
*Attorney, Agent, or Firm*—McDougall, Hersh & Scott

[57] ABSTRACT

An automated system for producing chain wherein individual pins are fed one-at-a-time to a heating station. The pins are heated in stages at said station to a temperature suitable for bending of the pins. The pins are automatically moved from said station by transfer and conveyor means to a bender where the pins are clamped in place and then bent in stages into an open-ended link shape. A robot picks up the link-shaped pins and places the pins one-at-a-time on the supporting surface of a closer. The robot then interlinks a welded link with a pin on the closer, and the pin on th closer is then closed. The robot then moves the closed pin to the welder for welding of the ends.

21 Claims, 11 Drawing Figures

FEED BOX
GATE SW.
RAILS
VIBR. (GATE)
PIN-ENDS CLEANER
SENSOR
SW.
COLD PIN TRANSFER
HEATER NO.1 ABT. 500°F.
HEATER NO.2 TO ABT. 1200°F.
DROP CAM
DROP THRU TROUGH
HOT PIN CONVEYOR (CABLE CYL.)
HOT PIN TRANSFER
DROP CAMS
DROP THRU TROUGH
PUSHER
HOT PIN
HOT PIN CONVEYOR
CABLE CYL.
LINK PUSH OFF
CLAMP
BENDER (LINK FORMER)

AUTOMATIC CHAIN MANUFACTURING SYSTEM

This invention relates to a system for producing chain. The invention is particularly concerned with an automated system which results in an extremely efficient chain making procedure.

The production of chain, particularly heavy chain, generally involves the use of a supply of straight pins. These pins are heated to temperatures sufficient to facilitate bending thereof. The bending forms an individual link, and this link is, of course, joined with other interconnected links so that a chain of a desired length is achieved.

The handling of the individual pins, the heating of the pins, bending operations, etcetera, can all be accomplished manually, in some cases with the use of appropriate tools. Original chain making procedures thus involved, for example, the use of forging tools, anvils, etc. Where particularly high strength chain is involved, welding of the ends of each link is necessary, and the welding operation also involved at least some manual handling.

Some machinery has been developed for facilitating chain making. For example, Phares U.S. Pat. No. 2,806,345 describes machinery used for holding links during trimming of weld flash. A chain link heating apparatus is described in Phares, et al. U.S. Pat. No. 3,909,575, issued on Sept. 30, 1975. An additional machinery disclosure relating to the holding of links during a heating operation is found in Phares U.S. Pat. No. 3,909,576, issued on Sept. 30, 1975.

Although individual operations involved in chain manufacture have been mechanized to a certain extent, an efficient and completely automated chain manufacturing system has not been developed. Thus, systems presently being employed for the manufacture of chain still involve some manually controlled handling operations, at least between the various steps of the manufacturing process. This limits the production efficiency for various reasons.

It is a general object of this invention to provide an improved system for the production of chain.

It is a more specific object of this invention to provide a system for the production of chain, particularly heavy chain, wherein automated operations characterize the production so that the necessity for manual control from the beginning to the end of the manufacturing operation is eliminated.

These and other objects of this invention will appear hereinafter and for purposes of illustration, but not of limitation, specific embodiments of the invention are shown in the accompanying drawings in which.

Figures 3, 4, 4A:
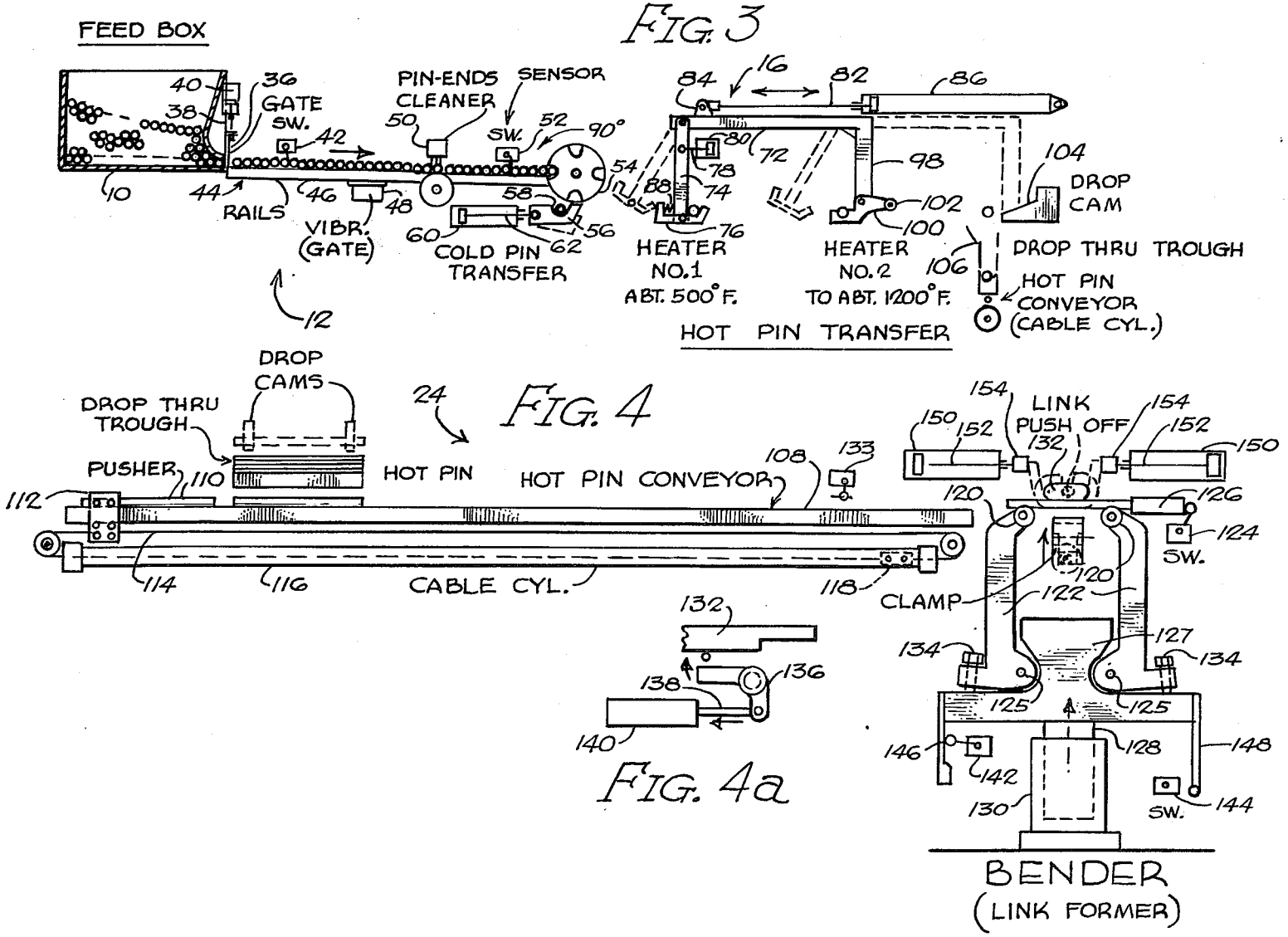
FIG. 3 is a diagrammatic side view of the pin feeding, transferring and heating mechanism.
FIG. 4 is a diagrammatic side elevation of the hot pin conveying and bender mechanisms utilized in the construction.
Figure 5:
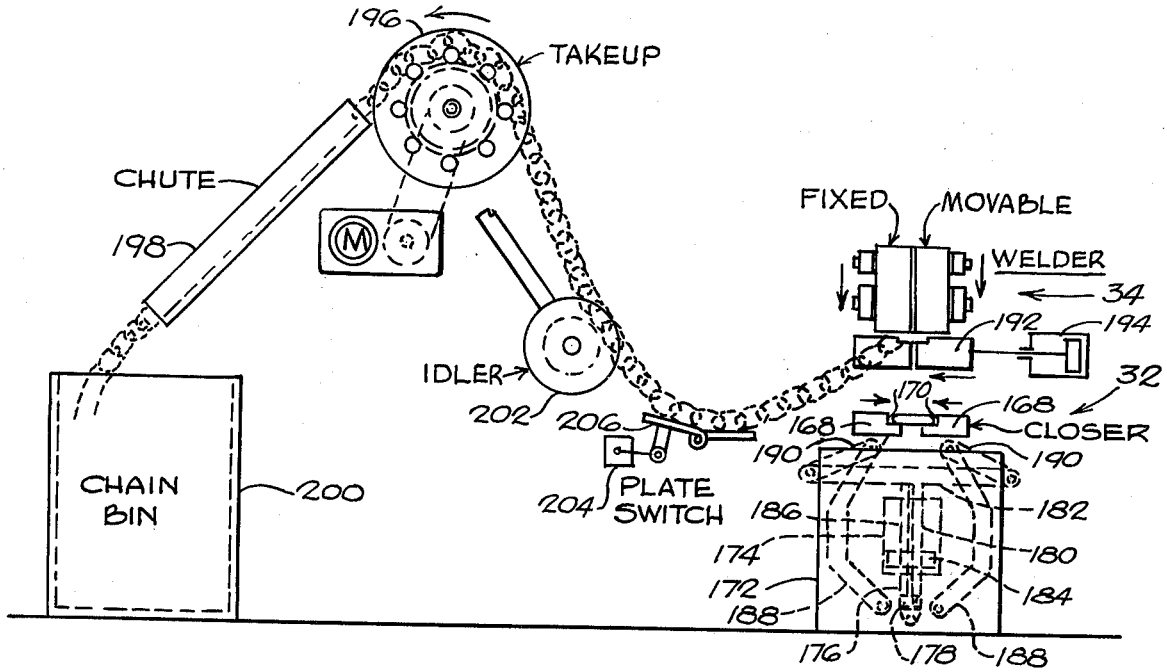
Figure 6:
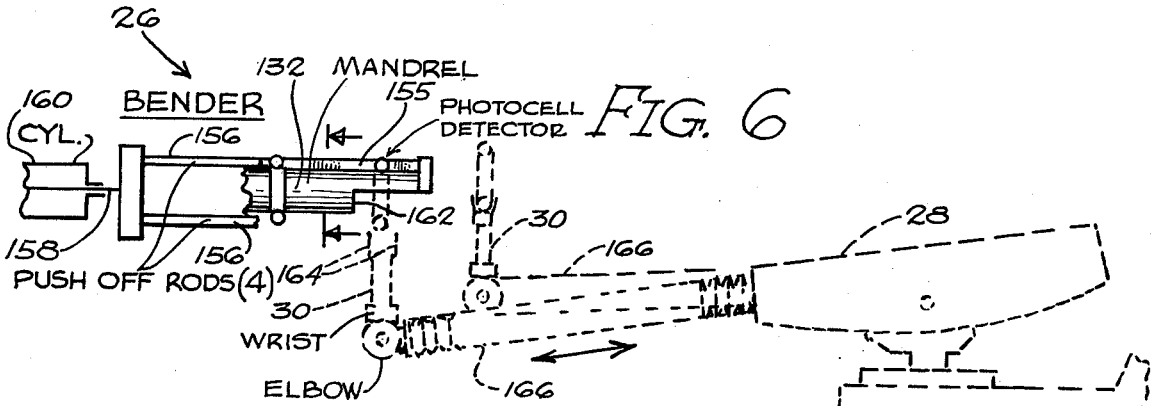
Figure 7:
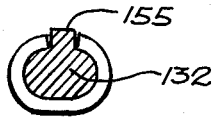
Figure 8:
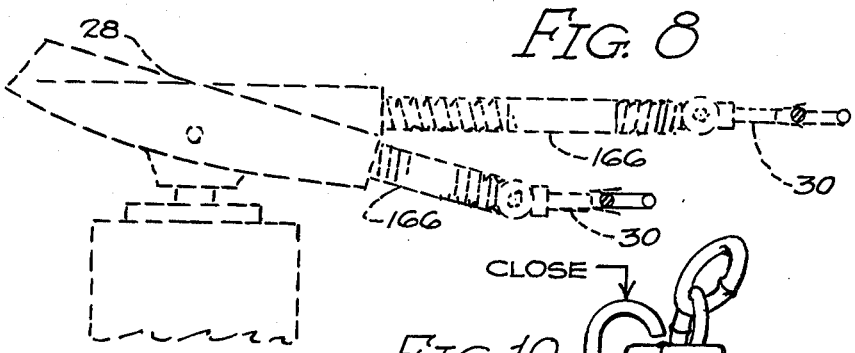
Figure 9:
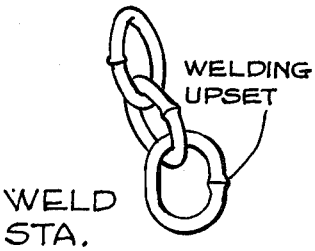
Figure 10:
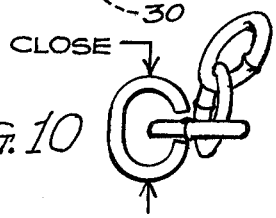

FIG. 4*a* is a side elevation of the clamp structure associated with the bender;

FIG. 5 is a diagrammatic illustration of the welding and take-up station of the construction;

FIG. 6 is a diagrammatic illustration of the robot in position at the bender prior to transfer of a link to the welding station;

FIG. 7 is a cross-sectional view taken about the line 7—7 of FIG. 6;

FIG. 8 is a side view of the robot illustrating positions assumed at the welding station;

FIG. 9 is an illustration of chain links which have been interconnected and welded; and, FIG. 10 is an illustration of the chain links along with a bent link prior to a final bending and welding operation.

The subject matter of the invention relates to an apparatus which includes a series of automatic operations whereby pins introduced into the apparatus are automatically formed into a chain formed of successive links. The apparatus first includes a holding means designed to feed or dispense pins one-at-a-time into the system. The pins are, in particular, fed to transfer mechanisms which include a first transfer means for receiving a single dispensed pin and for locating the pin at a heating station.

The heating station preferably includes means for heating the pins in stages. To accomplish this, a pin is delivered to a first heating station and clamped between heating electrodes. A second transfer mechanism operates to pick up the heated pin and to move the heated pin forwardly to a second heating station. The pin is then again clamped between electrodes for further heating of the pin to a temperature suitable for bending. The second transfer mechanism then returns to pick up a pin from the first heating station and then repeats the movement to the second heating station.

The second transfer mechanism includes a pin support for picking up pins from the second heating station and dropping them onto a hot pin conveyor which moves the pins to a bending station. The hot pins are clamped at this station, bent into a link shape having spaced apart ends, and then pushed out of the bending location. A bending mandrel is preferably utilized at this stage of the operation, and the newly formed links are pushed out to the end of the mandrel.

A robot is employed for picking up the links and delivering the links to a closing station. The robot operates to deposit a link on a supporting surface at the closing station, and the robot then picks up a link from a welding station. Except in the case of the first link of a new chain, this welded link will be connected with other links in a chain being produced.

The welded link is interlinked with the unwelded link at the closing station, and high pressure closing means are then operated to close the unwelded link. The robot then picks up the unwelded link which is now part of a chain section, and delivers the unwelded link to the welding station where that link is clamped and welded. In the meantime, the robot returns to the bending station for picking up a new unwelded link for delivering to the closing station.

As will become more apparent, in addition to the general automated concept of this invention, certain specific structural and method features are contemplated for protection. Thus, the invention relates to the general system described herein as well as individual features which are inventions of independent character.

Figure 1:
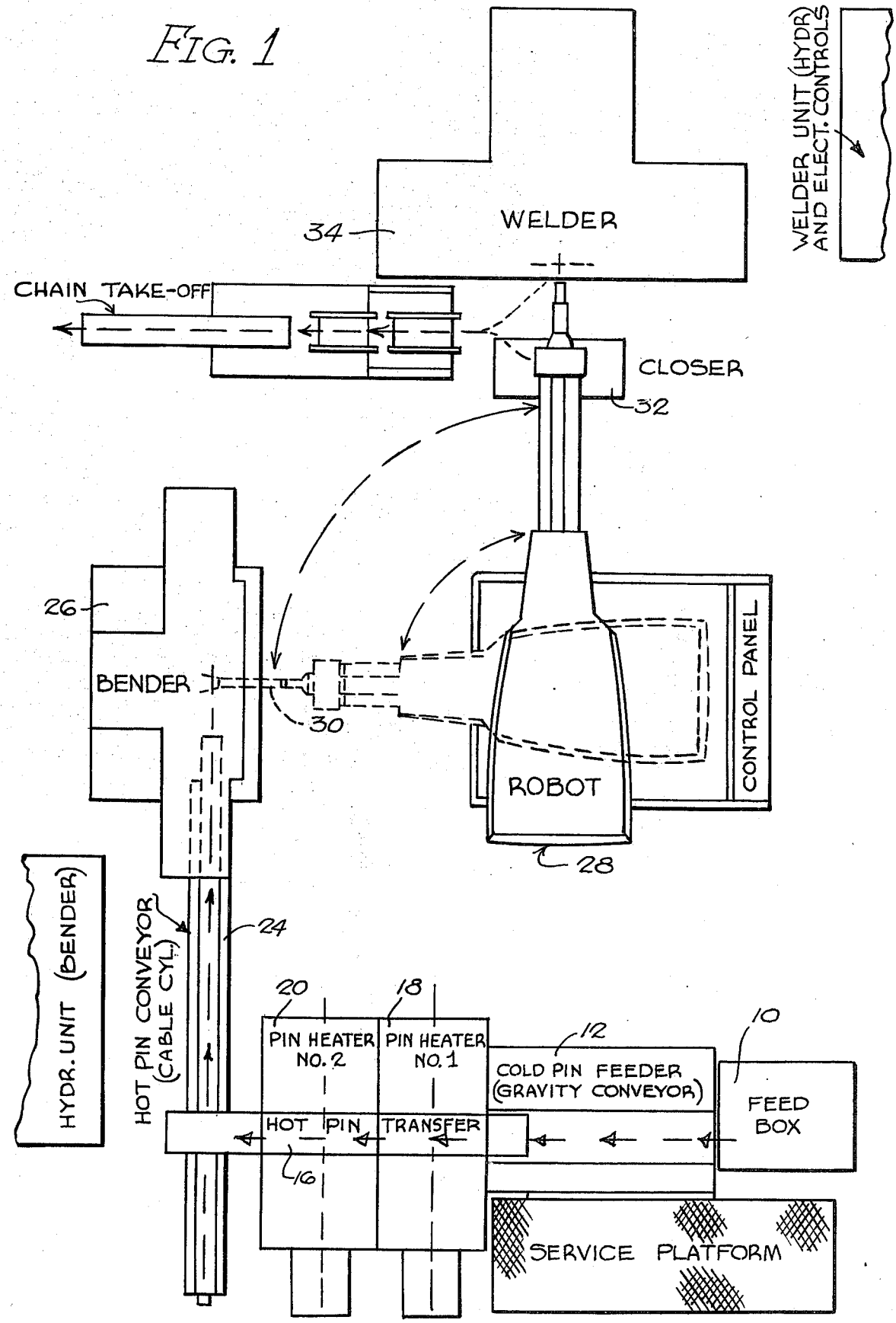
FIG. 1 is a schematic illustration of the chain manufacturing system characterized by the features of this invention.

The general concepts of the invention are described in more detail in FIG. 1 wherein the respective stages of the operation are diagrammatically illustrated. Individual pins are loaded in a feed box 10, and these pins are dispensed onto a feeder or conveyor 12. By means of the transfer means 16, the pins are first moved one-at-a-time to a heating station 18 and then to a heating station 20. Upon achievement of a desired bending temperature, the transfer means 16 serve to deliver the hot pins to a hot pin conveyor 24. This conveyor delivers the pins to bender 26 where the pins are formed into a link shape with each link defining spaced apart ends.

An important aspect of the invention involves the use of a robot 28 with this robot defining a gripping structure 30 whereby the robot is adapted to pick up links one-at-a-time from the bender 26. The robot is adapted to transfer these links to a link closer 32, and it also serves to bring a previously welded link (normally part of a chain section) from a welder 34 to the closer 32. The previously welded link can thus be interlinked with the link held by the closer, and the closer then operates to force the ends of the unwelded link together. The robot then picks up the unwelded link for delivery to the welder, and then returns to the bender to pick up another link.

Figure 2:
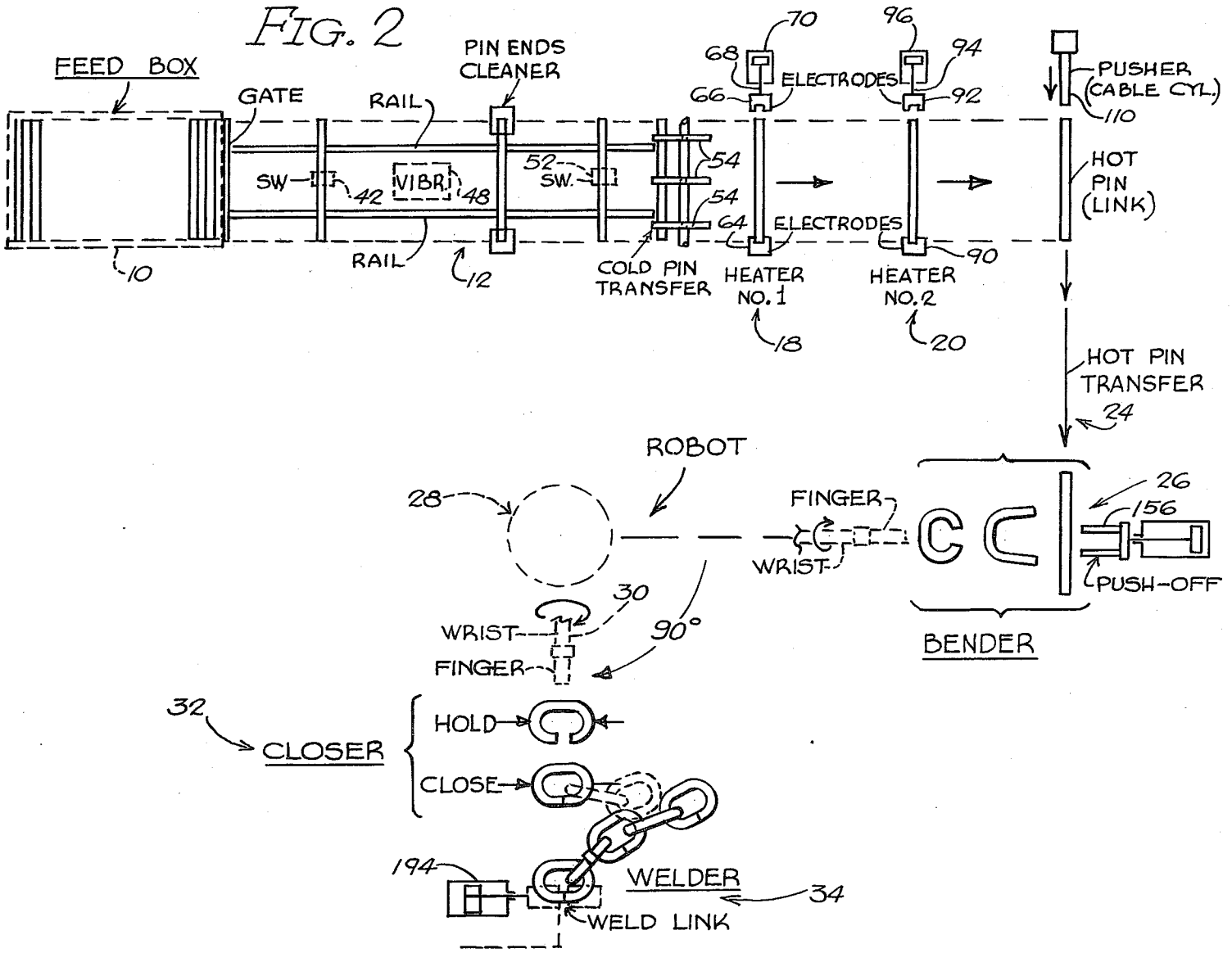
FIG. 2 is a diagrammatic illustration of various stages of the manufacturing operation.

FIGS. 2 and 3 illustrate, in more detailed fashion, certain aspects of the system described. As illustrated, the feed box 10 defines an interior space sufficient to hold a large number of pins. The end of the feed box is normally closed by means of gate 36. This gate is movable vertically upwardly by means of piston rod 38 actuated by cylinder 40. The operation of the piston is preferably controlled by means of a switch 42 positioned to engage each pin dispensed from the feed box. This switch is designed to operate the feed box whenever a new supply of pins from the feed box is desired. Thus, when the pins located on the feeder 12 have all moved past the switch, the absence of a pin will result in the dispensing action of the feed box 10.

The pins removed from the feed box drop onto inclined supporting rails or bed 46 forming part of the feeder 12. This bed is equipped with a vibrator 48, and the vibrator is also preferably controlled by switch 42. The vibrator facilitates dispensing of the pins since the bed 46 and box 10 are interconnected whereby the box is exposed to the vibratory action. It will be appreciated that the cylinder 40 must be operated in response to action of switch 42 at the same time as the vibrator action is initiated so that the box opening will be clear for the movement of the pins onto the bed 46.

An arrangement for cleaning the ends of the pins may be situated adjacent the bed 46 as shown at 50. Wire brush means or chemical means may be utilized at this point for purposes of insuring the removal of substances which might otherwise adversely affect the pin heating and welding operations.

A sensor switch 52 is positioned further down the inclined bed. This switch may operate an alarm system so that if the feed box empties or pins become hung up on the bed 46, an operator will be alerted. The switch 52 also preferably shuts down critical portions of the system to avoid damage thereto which might occur in the absence of the pins.

A dispensing wheel assembly 54 is positioned at the end of the bed 46. As shown in FIG. 2, this assembly may comprise 3 notched wheels with the notches spaced at 90° and each notch being dimensioned to receive one pin. Any suitable indexing means may be provided for moving the wheel assembly so that a pin is picked up during each 90° of movement.

A pin transfer mechanism 56 is positioned immediately beneath the wheel assembly, and this mechanism defines a receiving area 58 for pins dropped from the wheels. A cylinder 60 includes a piston 62 which is pivotally connected to the mechanism 56 whereby a pin is adapted to be carried forwardly by the mechanism when the piston is extended. The mechanism is, in particular, adapted to move each pin between electrodes 64 and 66. One or both of the electrodes are movable inwardly upon positioning of a pin by the mechanism 56 for clamping of the pin between the electrodes. The electrode 66 is illustrated as being mounted on piston 68 of cylinder 70 to illustrate such clamping capability. The mechanism 56 is, as shown in dotted lines, spring loaded whereby retraction of the piston 62 allows the mechanism 56 to pivot upon return movement to thereby disengage with respect to a pin delivered between the electrodes.

A pin transfer frame 72 includes a first downwardly extending arm 74, and this arm supports a pivoting pin carriage 76. A piston 78 is attached to the arm 74, and a cylinder 80 supported on the frame 72 is adapted for extending the piston 78 to pivot the arm 74 from the solid to the dotted line position shown in FIG. 3.

A piston 82 is attached to the bracket 84 supported on frame 72, and cylinder 86 is provided whereby the piston 82 operates to drive the frame 72 from the solid line to the dotted line position shown in FIG. 3. As will be further explained, the frame 72 is in the dotted line position when a pin is delivered between the electrodes 64 and 66. Upon extension of the piston 82, the pin carriage 76 is moved beyond the pin clamped between those electrodes, the piston 78 also being extended. Upon retraction of the piston 78, the arm 74 swings down into engaging position relative to the clamped pin. Since the carriage 76 is pivotally connected to the arm 74, and in view of the presence of spring 88, the carriage operates to cam over the pin before moving into the solid line position of FIG. 3.

When the piston 82 is now retracted after heating by the electrodes 64 and 66, the heated pin is moved into position between a second pair of electrodes 90 and 92. The pin is again clamped, for example, by means of the piston 94 and cylinder 96 associated with the electrode 92. This permits release of the pin by carriage 76 for return movement of that carriage to pick up the next pin.

The frame 72 also carries a rigid arm 98 which supports pivotally mounted carriage 100. When the piston 82 is extended upon return movement of the frame, the carriage 100, which is also spring loaded to the solid line position shown in FIG. 3, cams over the pin between electrodes 90 and 92 whereby this carriage will support the pin when these electrodes are unclamped. On the next cycle of movement, which involves retraction of piston 82, the end 102 of carriage 100 is driven against cam surface 104 which thereby pivots the carriage for dropping of the hot pin into trough 106.

The electrodes 64 and 66 and the electrodes 90 and 92 preferably comprise electrodes of a design which will accomplish resistance heating of the pins. Electrodes with clamping capabilities are described in the aforementioned U.S. Pat. No. 3,909,575. It will be appreciated that the design of the electrodes can be readily changed to accommodate heating of the straight pins utilized in the system described herein.

Iron base alloy compositions or other metal alloys commonly used in chain making are readily suited for use in conjunction with the described system. In a typical application, the pins are heated to about 1200°F. for efficient bending and welding. It has been found that the use of a first set of electrodes for accomplishing a major portion of the rise in temperature, for example to about 500°F, followed by a second heating to the desired temperature results in much greater operating efficiencies. The automated system of the invention operates rapidly and with highly satisfactory results in terms of the completed chain when the dual heating arrangement is employed. The structural arrangement, particularly the transfer means, is primarily responsible for achievement of these high efficiencies.

Hot pins which are dropped through the trough 106 are deposited on the hot pin conveyor which is best illustrated in FIG. 4. This conveyor preferably comprises a rail 108 defining a V-shaped centering groove in its upper surface. A pusher rod 110 is attached to bracket 112, and this bracket is mounted on the rail 108 for sliding movement along the rail. This sliding movement is accomplished by means of cable 114 which is attached to the bracket 112. A pneumatic cylinder 116 has a piston element 118 located therein, and the cable 114 is tied to this piston element.

Considering the position of the cable cylinder illustrated in FIG. 4, it will be appreciated that application of pressure at the right-hand end of the cylinder will drive the element 118 from right to left which will in turn drive the pusher against a hot pin mounted on the rail 108 whereby the pin is conveyed along the rail. The pin is eventually driven onto grooved rollers 120 mounted on arms 122 which are positioned at the end of the rail 108. A limit switch 124 is operated by means of actuator 126. When the actuator is engaged by a pin, this switch is in the control circuit for the cylinder 116 whereby pressure is applied in the cylinder at the left-hand end to thereby return the pusher rod 110 to its starting position.

The arrangement illustrated provides for clamping of pins against the mandrel 132. As best shown in FIG. 4*a*, the clamp comprises a lever 136 with one arm thereof being attached to piston rod 138 associated with cylinder 140. When the rod is retracted, the other end of the lever is driven into engagement with a pin positioned against the under surface of the mandrel 132. As indicated, the clamping action of the piston cylinder 140 is preferably controlled by switch 124.

The pair of arms 122 are pivotally connected at 125 to the head 127 which is secured at the end of piston 128. This piston is received within hydraulic cylinder 130, and upward movement of the piston serves to drive the arms 122 upwardly. This action is preferably controlled by means of switch 133 which is actuated by the pusher 110 on its return stroke.

When a pin is moved onto the rollers 120, and the pin becomes clamped against the bottom surface of mandrel 132, upward movement of the arms 122 results in bending of the pin around the mandrel. Adjusting bolts 134 are threaded into each arm, and these bolts determine the position of the arms relative to the head 127. With this arrangement, the bending action of the arms can be controlled so that the size of the lengths can be varied. Thus, by substituting a mandrel of a different size and adjusting the bolts 134, the arms 122 will achieve an appropriate bend in a given pin. It will also be appreciated that the cross-section of a pin, and the shape of a mandrel, may be varied depending upon the type of chain being produced.

Additional control switches 142 and 144 are associated with head 127. A first downwardly extending switch actuator 146 operates switch 142 when the head has completed the desired ascent. The switch 142 is included in a circuit which will prevent operation of the cable cylinder 116 so that the next hot pin cannot be delivered at this time. A second switch actuator 148 operates the switch 144 when the head 127 has completed its descent, and the circuitry may be designed so that this will actuate the push-off rods to be described and also the cable cylinder for movement of the next hot pin into position.

A pair of cylinders 150 shown in FIG. 4 each have piston rods 152 with bending elements 154 fixed on their outer ends. Operation of the cylinders 150 is controlled by switch 142 and therefore takes place when the arms 122 have completed their upward ascent. As illustrated, the elements 154 serve to bend the ends of the pin around the mandrel.

When the pin bending has been completed, a link shape is developed; however, there is a distinct gap between the link ends. As best shown in FIGS. 6 and 7, the mandrel defines a ridge 155 which is positioned between the link ends and which serves to guide the link during push-off after forming. Limit switches associated with the elements 154 control the operation of the push-off rods to be described.

The push-off occurs when the link is moved away from the bending position by means of push-off rods 156. Four of these rods are preferably employed, and the pushing action is achieved through the extension of piston 158 associated with cylinder 160. As best shown in FIG. 6, the push-off rods operate to move the link to the end of the mandrel 132. The mandrel is under-cut as shown at 162 so that the link hangs freely on the mandrel. If desired, a photocell detector or the like may be associated with the end of the mandrel to deliver a signal when a link has been pushed into position. This signal can then be used to actuate the robot 28 to pick up the link.

As indicated, the robot 28 is utilized at this point for purposes of picking up a link which is hanging freely on the mandrel 132. The robot design is not a part of this invention, and an example of a suitable unit is a unimate installation, Mark II, produced by Unimation Inc. of Danbury, Connecticut. As will become more apparent, the robot must basically comprise a main body portion which will swivel in a horizontal plane and pivot in a vertical plane. The unit must include an arm which will extend and retract, a "wrist" which will permit bending and swiveling of a "hand" attached to the wrist, and fingers attached to the hand for gripping purposes.

The gripping fingers 164 of the robot are utilized for grasping a link suspended from the mandrel 132, and the arm 166 of the robot is then retracted to remove the link. The robot then swivels into position adjacent closer 32 as shown in FIG. 1. The closer includes a pair of opposed plates 168 with the plates defining cut-out portions 170 for receiving a link as is illustrated in FIG. 5. The robot serves to deposit the link and then the link is released.

The closer includes a housing 172 which has a double acting cylinder and piston arrangement located therein. This comprises a first cylinder 174 and a coaxially positioned smaller cylinder 176. The smaller cylinder carries a piston 178 having a rod 180 which is connected to crossbar 182. The larger cylinder carries piston 184 and hollow rod 186 with the latter also being connected to crossbar 182.

The plates 168 are supported on pivotally attached arms 188, and links 190 interconnect the crossbar 182 and the arms 188. When a link is deposited by the robot, the smaller piston and cylinder arrangement is operated whereby the crossbar is raised sufficiently to locate the plates 168 in a low pressure relationship with respect to the link in the closer. In the meantime, the robot moves upwardly to grip a link positioned in the welder 34. As shown in FIGS. 9 and 10, the link from the welder is part of a length of chain, and the robot operates to turn this link and to move the link between the opposed ends of the link held by the closer. At this point, the cylinder 174 operates to apply high pressure through crossbar 182 whereby closing force is applied by the plates 168. The crossbar 182 is then pulled back to free the link in the closer, and the robot then operates to deliver the link to the welder 34. The welder may be of any suitable design including at least one clamp 192 movable by a cylinder and piston assembly 194 for gripping the link during the welding operation. The welder itself may include fixed and movable electrodes with the latter being movable with the clamp 192.

As illustrated, the newly formed chain section may be directed away from the welder and closer by means of a motorized take-up reel 196. This reel drives the chain section onto chute 198 for deposit in the bin 200. An idler 202 is positioned between the take-up end reel and a plate switch 204. The latter is associated with a pivoting plate 206 which senses the presence of the chain. When there is sufficient newly formed chain to pivot the plate clockwise, the switch 204 will serve to operate take-up reel 196 until the plate pivots back sufficiently to again actuate the switch. With this arrangement, the completed chain section is automatically moved away from the production apparatus.

As indicated, the construction described has been found to be extremely efficient from the standpoint of producing chain, particularly chain formed from heavy gauge material. It is contemplated, however, that some changes in the particular system described are possible without materially affecting the operating efficiency. For example, it is contemplated that induction heating means be associated with the hot pin conveyor including the rail 108 whereby heating to a desired bending temperature could be accomplished on this rail.

The system of the invention is characterized by highly efficient production, and this is particularly true when there is a desire to change the size of the chain being produced. The robot can readily adapt to different manufacturing procedures since many different programs could be utilized for operating the robot. Furthermore, there is a limited necessity for changing jigs or other fixtures when changing to a different size of chain. Thus, the various clamping elements and other parts are adapted to handle material of various sizes.

It will be understood that various other changes and modifications may be made in the system described herein without departing from the spirit of this invention particularly as defined in the following claims.

I claim:

1. An automated apparatus for producing chain including means for holding a supply of pins, means for dispensing the pins one-at-a-time from the holding means, a heating station for individually heating the pins, transfer means adapted to pick up pins dispensed from the holding means one-at-a-time and adapted to deliver the pins to said heating station, conveyor means for receiving pins from the heating station, a bender, said conveyor means delivering pins to the bender, means for supporting pins at the bender and means for bending each pin into a link shape with spaced-apart ends, a robot for picking up link-shaped pins one-at-a-time and delivering the link-shaped pins to a welding station, a closer in the vicinity of said welding station for supporting a link-shaped pin delivered by the robot, a welder at said welding station and means for supporting a link-shaped pin in said welder for welding said ends together, means operating the robot to interlink a welded link with a link-shaped pin supported in the closer, and means for operating the closer to force said ends together, said robot then delivering each link closed by the closer to said welder.

2. An apparatus in accordance with claim 1 wherein said means for dispensing the pins includes a box for holding a plurality of pins, a dispensing opening defined by said box, a gate normally closing said opening, a ramp positioned adjacent said gate, and means for periodically opening said gate to provide for movement of pins through said opening and onto said ramp.

3. An apparatus in accordance with claim 2 including vibrating means connected to said box and ramp for assisting in movement of pins out of the box and along the ramp, and including means for operating said vibrating means when said gate is open.

4. An apparatus in accordance with claim 3 including a sensor positioned adjacent said ramp for detecting the absence of pins on a section of the ramp, and means for opening said gate and operating said vibrating means in response to the detecting of the absence of pins by said sensor.

5. An apparatus in accordance with claim 1 wherein said dispensing means includes a ramp supporting a plurality of pins, a notched wheel assembly positioned at the end of said ramp, notches defined by the assembly being adapted to receive pins one-at-a-time, and means for indexing said assembly whereby individual pins are successively received by notches in the assembly and thereby removed one-at-a-time from said ramp.

6. An apparatus in accordance with claim 1 including spaced-apart electrodes at said heating station, means for introducing individual pins between electrodes, and means for clamping the pins between electrodes whereby current can be passed through the pins for heating of the pins.

7. An apparatus in accordance with claim 6 including a reciprocating carrier for moving individual pins from said dispensing means to a position between said electrodes.

8. An apparatus in accordance with claim 1 wherein said heating means comprise at least two sets of opposed electrodes, a transfer frame for carrying individual pins, means for clamping a pin between a first set of electrodes whereby current can be passed through the pin to heat the pin, first pin carrying means mounted on said transfer frame for picking up a heated pin from said first set of electrodes, and means for moving said frame to position said heated pin between a second pair of electrodes whereby current can be passed through the heated pin between the second set of electrodes to thereby further heat the pin.

9. An apparatus in accordance with claim 8 wherein said frame includes a second pin carrying means, said second pin carrying means picking up a pin from between said second set of electrodes, movement of said frame thereby moving the pin away from said second set of electrodes, said first pin carrying means thereby delivering a new pin between said second set of electrodes while said second carrying means is moving a pin away from said second set of electrodes.

10. An apparatus in accordance with claim 9 including a passage for movement of heated pins toward said bender, and means for automatically discharging a pin from said second carrying means into said passage.

11. An apparatus in accordance with claim 1 wherein said conveyor means comprises an elongated rail, and a reciprocating pusher for moving pins along the rail toward said bender.

12. An apparatus in accordance with claim 11 wherein said rail defines a V-shaped groove, said pusher means comprising a rod movable in said groove, and a reciprocating drive means for said rod.

13. An apparatus in accordance with claim 12 wherein said means for supporting said pins at said bender comprise spaced-apart arms, a mandrel positioned above a line extending between the supporting ends of said arms whereby a pin is adapted to be inserted between said mandrel and said ends, and means for driving said arms upwardly to thereby bend the opposite sides of said pin around said mandrel.

14. An apparatus in accordance with claim 13 including additional pin bending means adapted to engage said opposite sides of said pin, said bending means driving said opposite sides inwardly toward each other and around said mandrel.

15. An apparatus in accordance with claim 14 including means for clamping said pin on said mandrel prior to driving of said arms upwardly.

16. An apparatus in accordance with claim 1 wherein said bender includes a mandrel and means for bending a pin around the mandrel to form said link-shaped pin, and means for pushing said link-shaped pin along said mandrel away from the bending position, and a cut-out portion defined by said mandrel, said means for pushing the link-shaped pin moving the link-shaped pin into the region of said cut-out portion whereby a substantial section of the pin is exposed for engagement by said robot.

17. An apparatus in accordance with claim 1 wherein said closer defines a pair of spaced-apart link engaging plates, means defined by said plates for receiving a link-shaped pin carried to the closer by said robot, and means for driving said plates into engagement with said link-shaped pin.

18. An apparatus in accordance with claim 17 wherein said means for driving said plates comprise a double acting cylinder, said cylinder having first acting means for bringing said plates into low pressure engagement with a link whereby the ends of the link remain spaced-apart, and a second acting means for applying high pressure to said link-shaped pin, after the pin is interlinked with a welded link for thereby bringing said spaced-apart ends to a closed position.

19. An apparatus in accordance with claim 1 including means for moving chain sections away from said welder, said moving means including a driven take-up reel, a pivoting plate located between said take-up reel and said welder for supporting a portion of said section of chain, and a switch actuated by said pivoting plate, said switch controlling the operation of the motor for said take-up reel, the movement of a pre-determined amount of chain onto said plate resulting in pivoting thereof and actuation of said switch whereby said take-up reel intermittently operates to draw chain away from said welder.

20. An automated apparatus for producing chain from a supply of straight pins including a heating station for heating the pins, conveyor means for receiving pins from the heating station, a bender, said conveyor means delivering pins to the bender, means for supporting pins at the bender and means for bending each pin into a link shape with spaced-apart ends, a robot for picking up link-shaped pins one-at-a-time and for delivering the link-shaped pins to a welding station, a closer in the vicinity of said welding station for supporting a link-shaped pin delivered by the robot, a welder at said welding station and means for supporting a link-shaped pin in said welder for welding said ends together, means operating the robot to interlink a welded link with a link-shaped pin supported in the closer, and means for operating the closer to force said ends together, said robot then delivering each link closed by the closer to said welder.

21. An automated apparatus for producing chain from a supply of straight pins including means for heating the pins, a bender, means for delivering the heated pins to the bender, means for supporting pins at the bender and means for bending each pin into a link shape with spaced-apart ends, a link-shaped pin closer, a robot for picking up link-shaped pins one-at-a-time and delivering the link-shaped pins to said closer, means at the closer for supporting a link-shaped pin delivered by the robot, a welder and means for supporting a link-shaped pin in said welder for welding said ends together, means operating the robot to interlink a welded link with a link-shaped pin supported in the closer, and means for operating the closer to force said ends together, said robot then delivering each link closed by the closer to said welder.

* * * * *